US008911309B1

(12) United States Patent
Harihar et al.

(10) Patent No.: US 8,911,309 B1
(45) Date of Patent: Dec. 16, 2014

(54) BATTING SLEEVE SENSOR SYSTEMS

(76) Inventors: John Harihar, New York, NY (US); Kevin Sankhi, New York, NY (US)

( * ) Notice: Subject to any disclaimer, the term of this patent is extended or adjusted under 35 U.S.C. 154(b) by 139 days.

(21) Appl. No.: 13/587,905

(22) Filed: Aug. 16, 2012

Related U.S. Application Data

(60) Provisional application No. 61/524,640, filed on Aug. 17, 2011.

(51) Int. Cl.
*A63B 69/00* (2006.01)
*A63B 59/00* (2006.01)

(52) U.S. Cl.
CPC ..... *A63B 69/0002* (2013.01); *A63B 2069/0004* (2013.01); *A63B 2069/0008* (2013.01); *A63B 2220/05* (2013.01); *A63B 2220/805* (2013.01); *A63B 2220/89* (2013.01)
USPC ..... 473/453; 473/458

(58) Field of Classification Search
CPC ..... A63B 69/00; A63B 69/0002; A63B 2069/0004; A63B 2069/0008; A63B 2220/05; A63B 2220/805; A63B 2220/89
USPC ..... 473/453, 437, 457, 451, 422, 202, 224, 473/221
See application file for complete search history.

(56) References Cited

U.S. PATENT DOCUMENTS 3,323,367 A * 6/1967 Searle ..... 473/202
3,623,724 A * 11/1971 Lande ..... 473/437
4,000,893 A * 1/1977 Evans ..... 473/437
4,583,733 A 4/1986 Ito et al.
4,861,034 A * 8/1989 Lee ..... 473/202
5,542,676 A * 8/1996 Howe et al. ..... 473/202
5,895,328 A * 4/1999 Pahio ..... 473/224
5,980,397 A * 11/1999 Hart et al. ..... 473/437
5,984,810 A * 11/1999 Frye et al. ..... 473/455
6,173,610 B1 * 1/2001 Pace ..... 73/493
6,533,685 B1 * 3/2003 Otten et al. ..... 473/437
7,536,033 B2 5/2009 Kirby
7,540,813 B2 * 6/2009 Liberatore ..... 473/457
7,775,899 B1 * 8/2010 Cannon ..... 473/226
7,780,543 B2 * 8/2010 Flood ..... 473/437
8,231,484 B1 * 7/2012 Quinn ..... 473/437
2004/0082414 A1 4/2004 Knox
2006/0183546 A1 * 8/2006 Addington et al. ..... 463/37
2006/0211523 A1 9/2006 Sabatino
2009/0221388 A1 * 9/2009 Giannetti et al. ..... 473/457
2010/0049468 A1 2/2010 Papadourakis
2013/0196769 A1 * 8/2013 Shocklee ..... 463/37
2014/0113752 A1 * 4/2014 Westcott ..... 473/422

* cited by examiner

*Primary Examiner* — Mitra Aryanpour
(74) *Attorney, Agent, or Firm* — RG Patent Consulting, LLC; Rachel Gilboy

(57) ABSTRACT

Batting Sleeve Sensor is a device that slides over or couples to a bat in order to record the statistics of each hit made. The invention may allow a user to analyze his or her hitting and make adjustments faster. The device takes only a few seconds to slip over (or otherwise couple to) an existing bat before a user can swing away as per usual. The hits are recorded via sensing means and are displayable in real-time. Athletes who play in competitive sports may find use in the device to train themselves to hit reliably and accurately over extended periods.

18 Claims, 5 Drawing Sheets

BATTING SLEEVE SENSOR SYSTEMS

CROSS-REFERENCE TO RELATED APPLICATION

The present application is related to and claims priority from prior provisional application Ser. No. 61/524,640, filed Aug. 17, 2011 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

1. Field of the Invention

The following includes information that may be useful in understanding the present invention(s). It is not an admission that any of the information provided herein is prior art, or material, to the presently described or claimed inventions, or that any publication or document that is specifically or implicitly referenced is prior art.

The present invention relates generally to the field of sporting accessories and more specifically relates to a batting sleeve sensor system.

2. Description of the Related Art

Many individuals play sports and are involved regular exercise regimens to promote health and fitness as well as for a means of providing entertainment. Many of these individuals play sports such as baseball, tennis, cricket and other such sports in a competitive mode. Much practice is required to become proficient at the various skills. For example baseball requires proper hitting, catching and other techniques to be developed. When baseball, softball or cricket athletes take batting practice, most of the time they are unsure where exactly the ball is striking the bat during a practice session. Without that information, it may be difficult for an athlete to adjust his or her swing to improve hitting performance. A more accurate method for collecting batting data is necessary and desired.

Various attempts have been made to solve the above-mentioned problems such as those found in U.S. Pat. and Pat. Nos. 2004/0082414; 2010/0049468; 2006/0183546; 2006/0211523; U.S. Pat. Nos. 7,536,033; and 4,583,733. This art is representative of sporting accessories. None of the above inventions and patents, taken either singly or in combination, is seen to describe the invention as claimed.

Ideally, a batting sleeve sensor system should be user-friendly and, yet would operate reliably and be manufactured at a modest expense. Thus, a need exists for a reliable batting sleeve sensor system to allow a user to analyze his or her hitting in order to make real-time adjustments and to avoid the above-mentioned problems.

BRIEF SUMMARY OF THE INVENTION

In view of the foregoing disadvantages inherent in the known sporting accessories art, the present invention provides a novel batting sleeve sensor system. The general purpose of the present invention, which will be described subsequently in greater detail is to provide an accurate analyzing means for swings used in baseball; to remove guesswork of hitting.

Batting Sleeve Sensor is a device that slides over (or wraps around) a bat in order to record the statistics of each hit. The invention may allow a user to analyze his or her hitting and make adjustments faster than with no input being present. The device takes only a few seconds to slip over (or couple to) an existing bat before a user can swing away. The device doesn't substantially alter the swing or change the weight of the bat. Athletes who play a sport using a bat looking for improvement in hitting accuracy should find use with the present invention.

A batting sleeve sensor system is disclosed herein, in a preferred embodiment comprising: a sleeve comprising a front surface, a back surface, a top side, a bottom side, a right side, a left side, and at least one memory card-receiving pocket; at least one sensor (preferably a plurality strategically placed); a memory card; a computer; a displaying device; and wiring suitable to communicate signals to and from the at least one sensor. The parameters of the sleeve are defined by the front surface; the back surface; the top side; the bottom side; the right side; and the left side. The at least one memory card-receiving pocket receives the at least one memory card (or other electronic device), such that the at least one memory card is secured in place relative to the sleeve. Further, the at least one memory card-receiving pocket is preferably located on the back surface of the sleeve (other placement may be used).

The sleeve preferably comprises fabric in preferred embodiments; however may comprise other materials in alternate embodiments. The sleeve may further comprise hoop and loop fastener strips such as those produced by companies under the name Velcro®. The sleeve is able to be wrappably-installable about a barrel and handle of a baseball bat by overlapping the left side over the right side and attaching the hoop and loop fastener strips together. Slide on versions are available as well. The barrel comprises a barrel-circumference of which the sleeve surrounds when installed. The handle comprises a handle-circumference that increases (when approaching the barrel) of which the sleeve surrounds when installed. The sleeve may further comprise indicia such as a sweet spot target. The sweet spot target is divided into four quadrants that are able to map hits when (sensors are) impacted by a ball.

The memory card is attachable to the handle of the bat or within confines of memory card-receiving pocket (mentioned previously). The memory card is capable of saving all measured statistics collected during at least one batting session (or part thereof). A computer may be in communication with and able to read the memory card via suitable means known in the art and is able to retrieve the information about placement of each of the hits such that the user is able to make proper adjustments to swing and stance of a user to develop accuracy of the hits according to input received from use of the present invention.

The displaying device permits the user to observe the information in real-time such that it is increased in effectiveness. The displaying device may comprises a specialty monitor attachable to rigid netting for viewing by the user (or coach or audience member), the displaying device being impact-resistant to rough use, impact, and vibration. The wiring communicates the signals to and from the at least one sensor allowing the sensor to measure a measurable property able to be communicated to the computer via the memory card (or other suitable equivalent). The wiring is integral within the sleeve. The sleeve when installed onto the bat is able to permit the at least one sensor to sense and record information relating to the measurable property relative to use of the bat to improve a game play of the user.

A kit is described herein for sale including: a sleeve; at least one sensor; a memory card; software to implement use of the computer and the monitor to display real-time; and a set of user instructions and practice techniques.

A method of using a batting sleeve sensor system is also disclosed herein preferably comprising the steps of: wrapping (or otherwise engaging) a sleeve about a bat (baseball; cricket; tennis; racquetball; or the like); hitting a ball; and analyzing the hitting to improve the hitting via an output recorded from sensors located in the sleeve. The method further comprising the step of recording the hitting of ball over a duration to create an overall analysis to promote accuracy in hitting.

The present invention holds significant improvements and serves as a batting sleeve sensor system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, batting sleeve sensor system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a sporting accessories device and more particularly to a batting sleeve sensor system as used to improve a batter's swing/hitting and make adjustments through accurate analyzing means. The device can be sized and shaped differently to accommodate bats and rackets and various sports equipment.

Generally speaking, batting sleeve sensor (systems) is a device that can provide users with data about his or her batting technique. The product may be comprised of a thin piece of nylon or other suitable material that slips over the bat. The nylon may be divided into four sections, to better map the hits, and has sensors imbedded in the fabric. The invention may also include a memory card that attaches to the handle of the bat. The card may be capable of saving all the statistics collected during a batting session. A user may take the memory card and plug it into a computer, where they can retrieve the information about the placement of each hit. Once the report is uploaded, he or she may be able to make the proper adjustments to his or her swing and stance.

Figure 1:
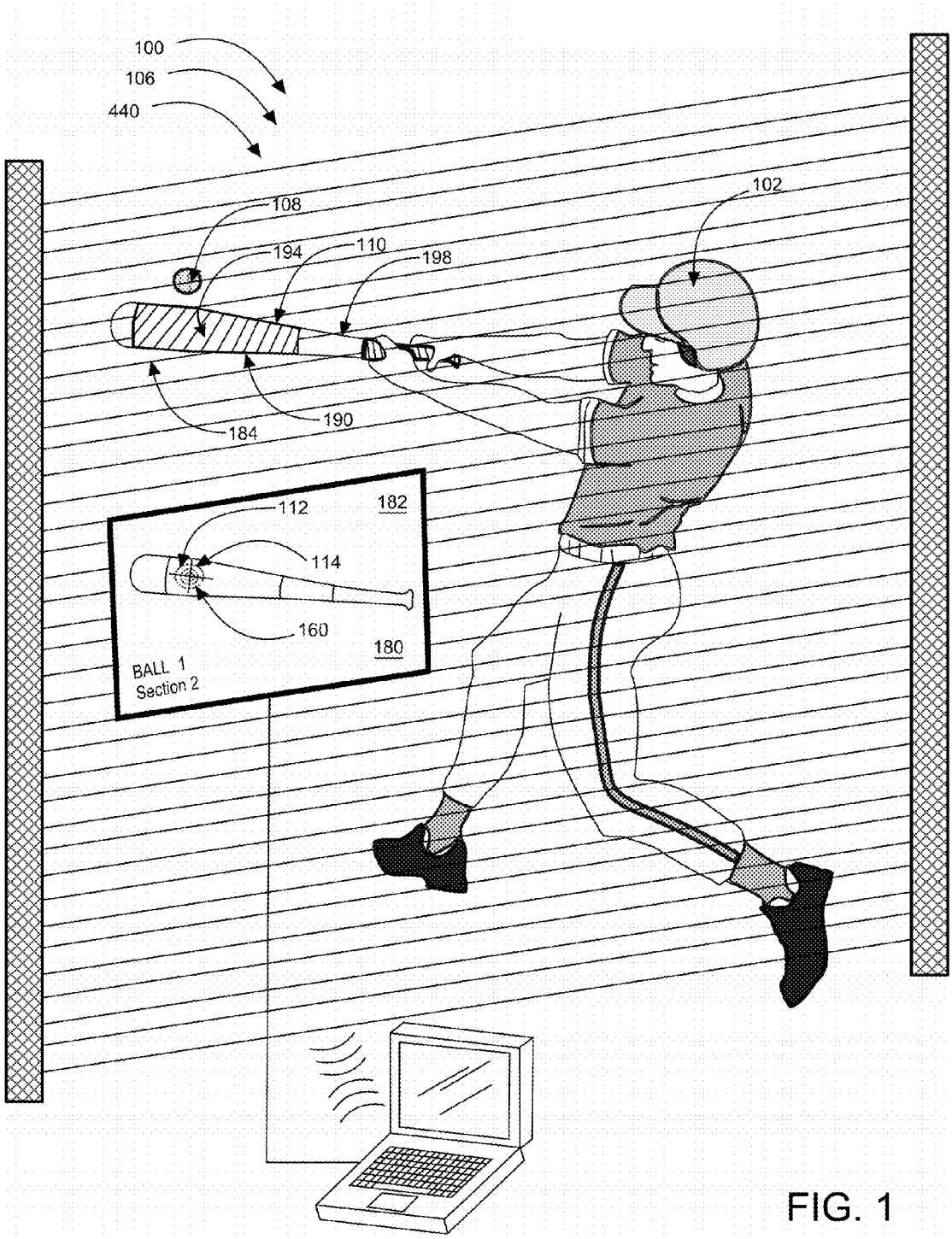
FIG. 1 shows a perspective view illustrating a batting sleeve sensor system in an in-use condition according to an embodiment of the present invention

Referring to the drawings by numerals of reference there is shown in FIG. 1 showing a perspective view illustrating batting sleeve sensor system 100 in in-use condition 106 according to an embodiment of the present invention.

Batting sleeve sensor system 100 preferably comprises: sleeve 110 having: front surface 116, back surface 122, top side 128, bottom side 134, right side 120, left side 118, and at least one pocket 152 (suitable to hold an electronic recording device such as memory card 300); at least one sensor 160; and wiring 170 suitable to communicate signals to and from at least one sensor 160. The parameters of sleeve 110 are defined by front surface 116, back surface 122, top side 128, bottom side 134, right side 120, and left side 118. At least one memory card-receiving pocket 152 preferably receives at least one memory card 300, such that memory card 300 is secured in place relative to sleeve 110. Further, at least one memory card-receiving pocket 152 is preferably located on back surface 122 of sleeve 110.

Sleeve 110 is preferably removably-installed about barrel 194 and handle 198 of bat 190. Sleeve 110 when installed onto bat 190 is able to permit at least one sensor 160 to sense (when impacted) and record information relating to the measurable property relative to use of bat 190. Measurable properties may include forces, speeds, directions and other such parameters. Wiring 170 preferably communicates the signals garnered to and from at least one sensor 160 thereby allowing sensor 160 to measure and communicate the measurable property. Wiring 170 is preferably integral within sleeve 110 or may be wireless in alternate embodiments.

Referring now to bat 190; barrel 194 comprises a barrel-circumference of which sleeve 110 surrounds when installed. Handle 198 comprises a handle-circumference (that increases when approaching barrel 194) of which sleeve 110 surrounds (envelopes) when installed. Sleeve 110 preferably comprises indicia 112. Indicia 112 comprises 'visible' sweet spot target 114. Sweet spot target 114 may be divided into four quadrants that are able to map hits when sensor 160 (strategically placed within and surrounding sweet spot target 114) are impacted by ball 108. Hits on sensor 160 based on placement are calculated to indicate the type of hit and relative placement on the field. In this way user 102 is able to refine his/her hitting to cause ball 108 to hit bat 190 in a specific spot to get a specific hit (result); thereby enabling reliability to be realized. Speed of swinging may lead to desired placement on the field (short hits or long hits). In a real game this may be duplicated to obtain the desired hit as per on-field situation. The present invention also helps user 102 to think in 'strategic terms'. Sensor 160 (and memory card 300) may be of different types; those suitable to specific use, cost and durability desired may be used.

Bat 190 may be a term used herein to specifically describe a baseball-bat; a cricket bat or more generally describe other sporting rackets/devices with handles. Upon reading this specification, it should be appreciated that, under appropriate circumstances, considering such issues as user preferences, design preference, structural requirements, marketing preferences, cost, available materials, technological advances, etc., other sporting equipment such as, for example, badminton, lacrosse, racquetball, tennis, etc., may be sufficient.

Batting sleeve sensor system 100 preferably further comprises displaying device 180 for observing information in real-time such that information received is most efficient analyzed and implemented. Displaying device 180 preferably comprises monitor 182 attachable to rigid netting 184 (via suitable fastening means such as clips, ties or the like) for viewing by user 102; displaying device 180 being impact-resistant to rough use, impact, and vibration. Those with ordinary skill in the art will now appreciate that upon reading this specification and by their understanding the art of sensors, memory cards, sensing means, electrical communication means as described herein, methods of recording, communications therebetween, displaying and analyzing, wiring options such as hardwired and wireless will be understood by those knowledgeable in such art.

Figure 2:
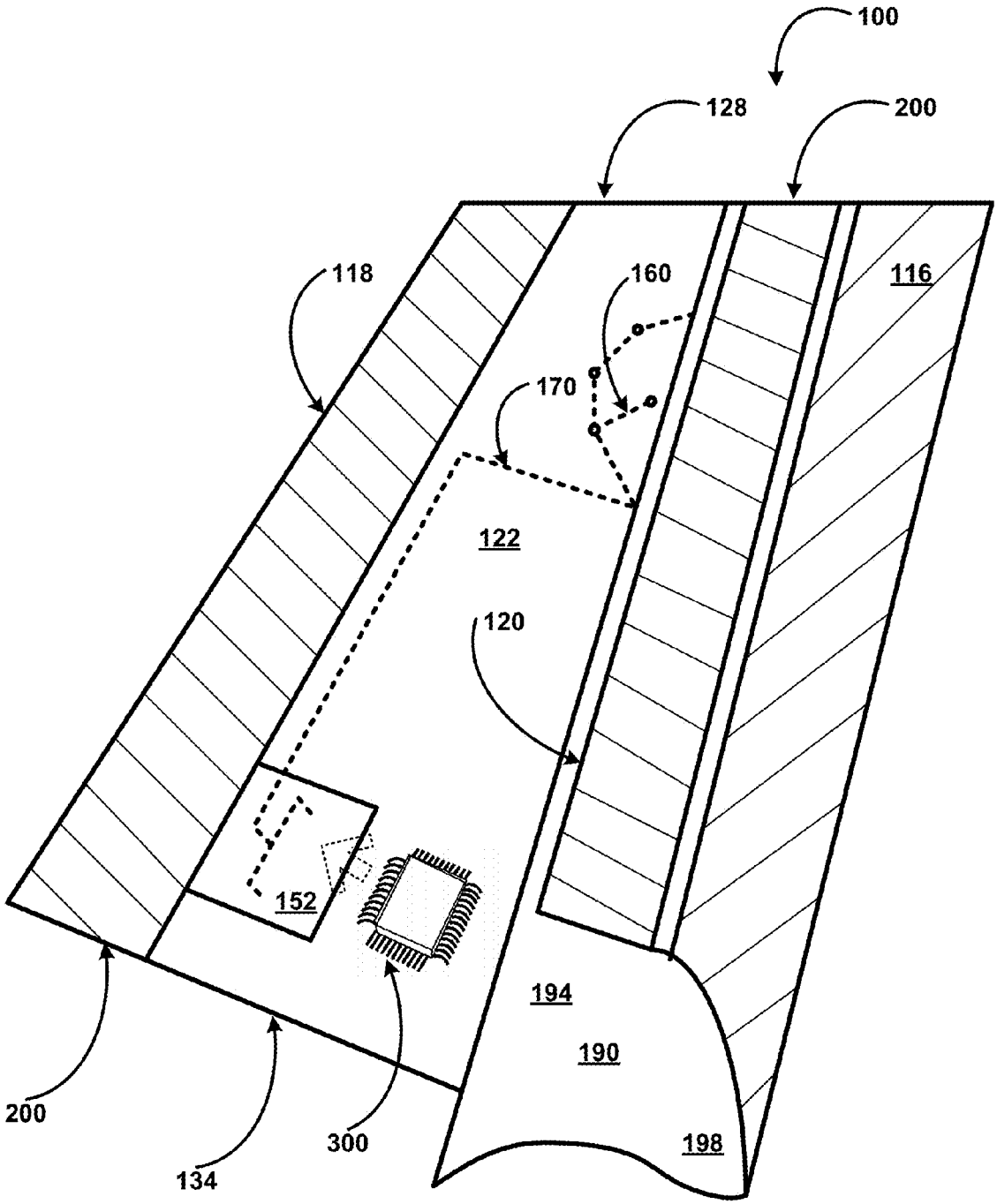
FIG. 2 is a perspective view illustrating a batting sleeve as removably positionable about a circumference of a barrel (and handle) of a bat according to an embodiment of the present invention of FIG. 1.

Referring now to FIG. 2, a perspective view illustrating batting sleeve 110 as removably positionable about a circumference of barrel 194 of bat 190 according to an embodiment of the present invention of FIG. 1. The present invention may be slid (as shown in FIG. 3) or coupled onto bat 190; coupling means made to accommodate different sized bats 190.

Sleeve 110 preferably comprises fabric. Upon reading this specification, it should be appreciated that, under appropriate circumstances, considering such issues as user preferences, design preference, structural requirements, marketing preferences, cost, available materials, technological advances, etc., other material arrangements such as, for example, nylon, spandex, flexible cotton, various plastic and non-plastic materials, composites; etc., may be sufficient.

Sleeve 110 further preferably comprises hoop and loop fastener strips 200. Sleeve 110 is wrappably-installable about bat 190 by overlapping left side 118 over right side 120 and attaching hoop and loop fastener strips 200. As mentioned, this version enables accommodation of different sized/shaped bats 190. Other versions may be stretched to conform. Upon reading this specification, it should be appreciated that, under appropriate circumstances, considering such issues as user preferences, design preference, structural requirements, marketing preferences, cost, available materials, technological advances, etc., other fastener arrangements such as, for example, buttons, snaps, clips, etc., may be sufficient.

Figure 3:
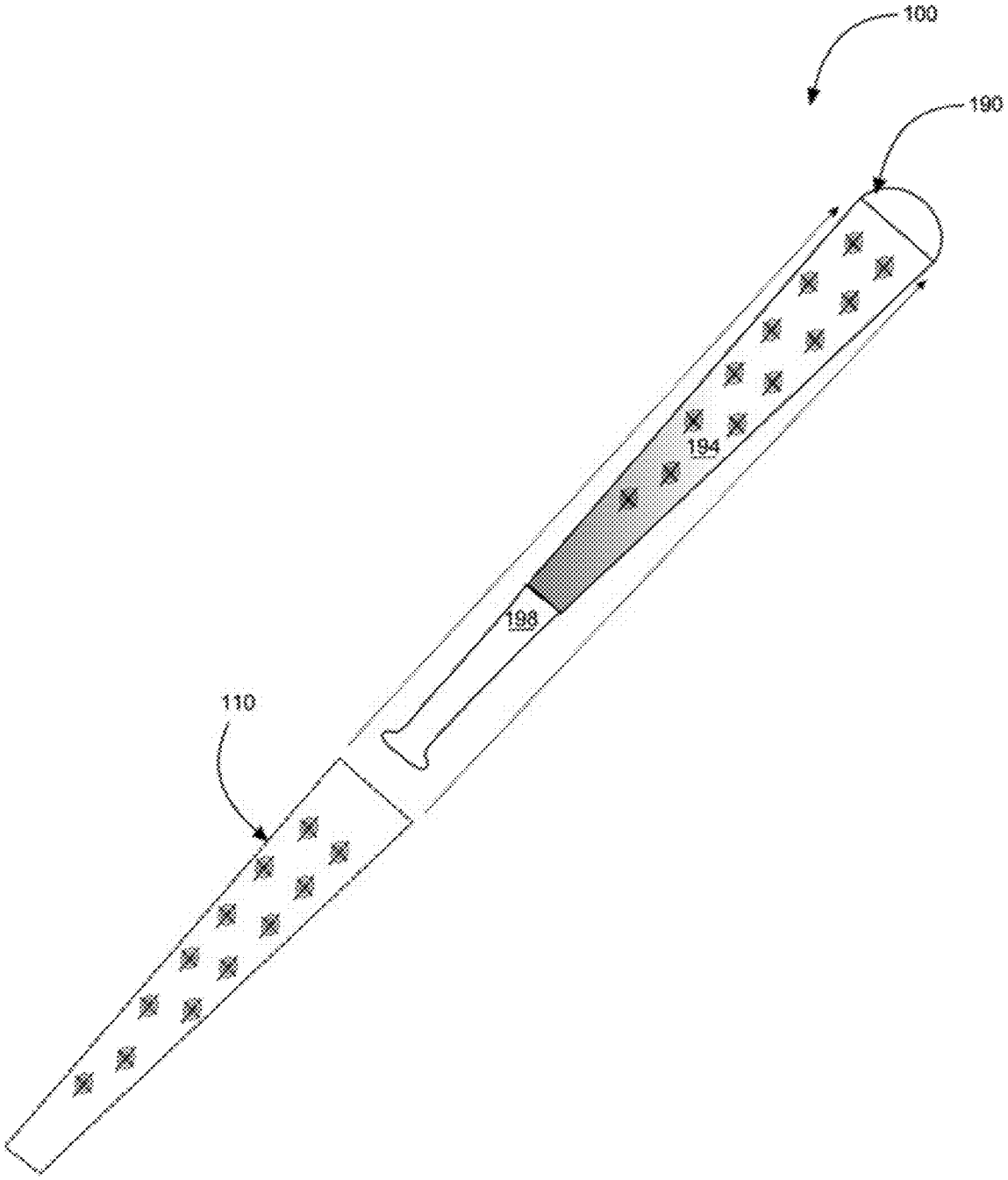
FIG. 3 is a perspective view illustrating the batting sleeve as coupled about the circumference of the barrel of the bat according to an embodiment of the present invention of FIG. 1.

Referring now to FIG. 3, a perspective view illustrating batting sleeve 110 as coupled about the circumference of barrel 194 of bat 190 according to an embodiment of the present invention of FIG. 1.

Sleeve 110 may be slidably-installable onto bat 190. Memory card 300 may be attached to handle 198 of bat 190. Memory card 300 is capable of saving all measured statistics collected during at least one batting session. A computer able to read memory card 300 and able to retrieve the information about placement of each of the hits such that user 102 is able to make proper adjustments to swing and stance of user 102 (as shown in FIG. 1).

Figures 4, 4A, 4B:
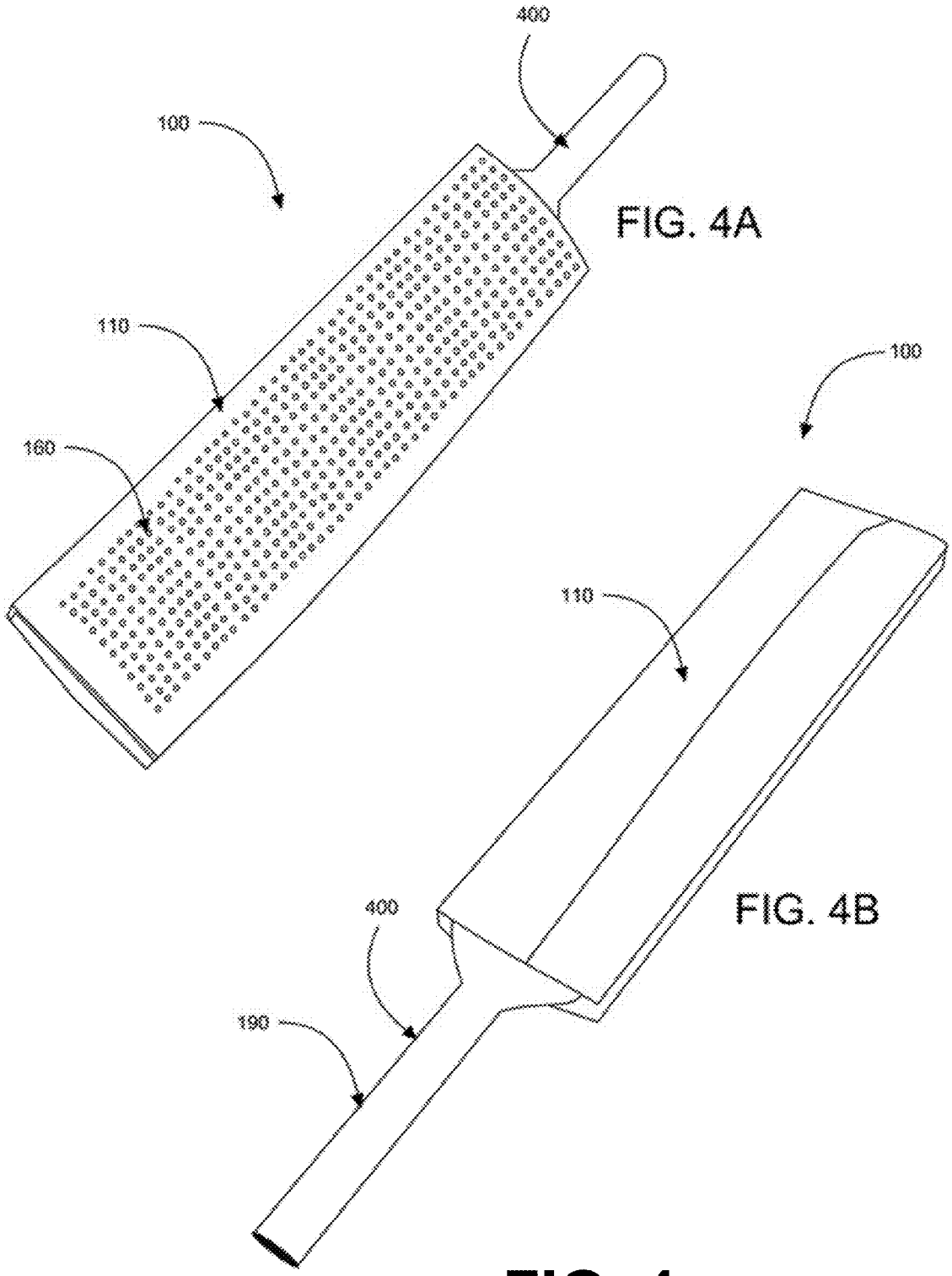
FIG. 4A is a front view of a batting sleeve as coupled to a cricket bat according to an alternate embodiment of the present invention of FIG. 1.
FIG. 4B is a rear view of a batting sleeve as coupled to a cricket bat according to an alternate embodiment of the present invention of FIG. 1.

FIGS. 4A and 4B are perspective views (front and back, respectively) of batting sleeve 110 as coupled to cricket bat 400 according to an alternate embodiment of the present invention of FIG. 1.

As previously mentioned, the present invention may also be used in conjunction with cricket bats 400, as shown (front and back views). In a similar fashion the device serves to promote accuracy and reliability in hitting ball 108. Force, speed and other parameters may also be recorded to help improve the hits by user 102. Outputs may then be implemented for reliability of the game of user 102.

Batting sleeve sensor system 100 may be sold as kit 440 comprising the following parts: sleeve 110; at least one sensor 160; memory card 300; software to implement use of a computer and a monitor to display real-time; and a set of user instructions and practice techniques. Batting sleeve sensor system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 5:
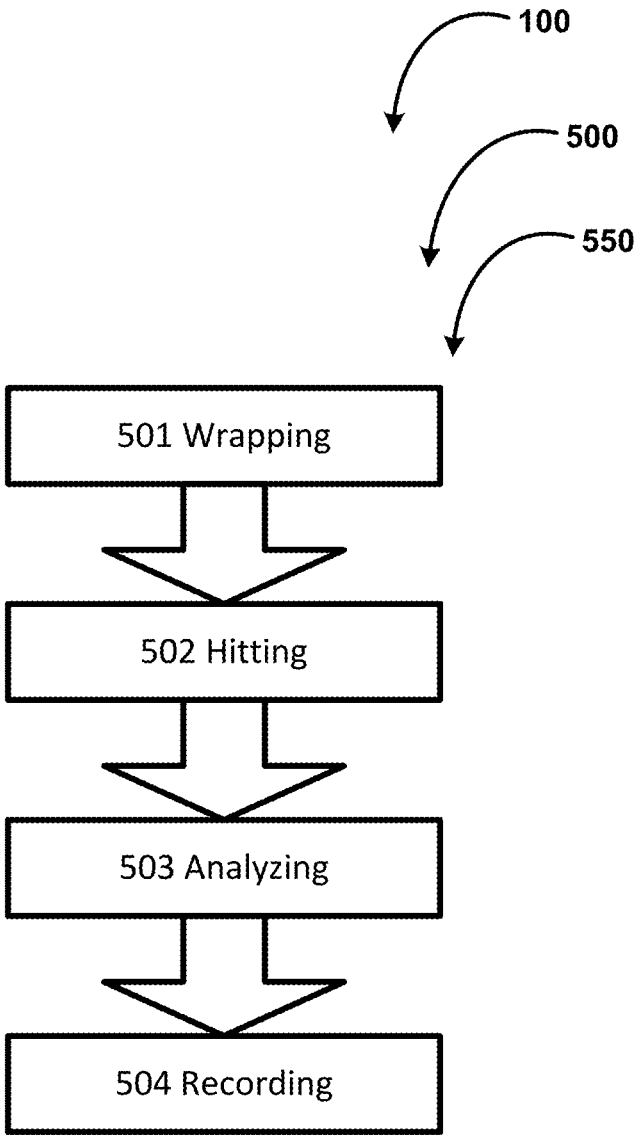
FIG. 5 is a flowchart illustrating a method of use for the batting sleeve sensor system according to an embodiment of the present invention of FIGS. 1-4B.

Referring now to FIG. 5, a flowchart 550 illustrating a method of use 500 for batting sleeve sensor system 100 according to an embodiment of the present invention of FIGS. 1-4B.

A method of using batting sleeve sensor system 100 comprising the steps of: step one 501 wrapping (or otherwise coupling) sleeve 110 about bat 190; step two 502 hitting a ball 108; step three 503 analyzing hitting to improve hitting via an output recorded from sensors 160 located in sleeve 110; and step four 504 recording hitting of ball 108 over a duration to create an overall analysis to promote accuracy in hitting.

It should be noted that step 504 is an optional step and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A batting sleeve sensor system comprising:

a sleeve comprising;

a front surface; a back surface; a top side; a bottom side; a right side; a left side; and at least one pocket;

at least one sensor; and wiring suitable to communicate signals to and from said at least one sensor;

wherein parameters of said sleeve are defined by said front surface; said back surface; said top side; said bottom side; said right side; and said left side;

wherein said at least one pocket is located on said back surface to receive an electronic device secured in place relative to said sleeve;

wherein said sleeve is removably positioned about a barrel portion and handle portion of a bat;

wherein said barrel portion comprises a circumference and said sleeve surrounds said circumference of said barrel;

wherein said handle portion comprises a circumference that increases when approaching said barrel portion of which said sleeve surrounds;

wherein said signals from said wiring, communicate with said at least one sensor allowing said at least one sensor to measure a measurable property;

wherein said wiring is integral with said sleeve; and wherein said at least one sensor senses and records information relating to said measurable property when said sleeve is positioned on said bat.

2. The batting sleeve sensor system of claim 1 wherein said sleeve is formed from a fabric.

3. The batting sleeve sensor system of claim 2 wherein said fabric is a nylon.

4. The batting sleeve sensor system of claim 3 wherein said sleeve is slidably positioned on said bat.

5. The batting sleeve sensor system of claim 3 wherein said sleeve further includes hook and loop fastener strips.

6. The batting sleeve sensor system of claim 5 wherein said sleeve is wrapped around said bat by overlapping said left side over said right side and attaching said hook and loop fastener strips together.

7. The batting sleeve sensor system of claim 5 wherein said sleeve comprises indicia.

8. The batting sleeve sensor system of claim 7 wherein said indicia includes a sweet spot target.

9. The batting sleeve sensor system of claim 8 wherein said sweet spot target is divided into four quadrants that is able to map hits when impacted by a ball.

10. The batting sleeve sensor system of claim 9 wherein a memory card is attached to said handle portion of said bat.

11. The batting sleeve sensor system of claim 10 wherein said memory card is capable of saving and thereafter communicating all measured statistics collected during at least one batting session.

12. The batting sleeve sensor system of claim 11 further comprising a computer, able to read said memory card and able to retrieve said measured statistics of said mapped hits such that a user is able to make proper adjustments to said user's bat swing and stance.

13. The batting sleeve sensor system of claim 12 further comprising a displaying device for observing said measured statistics in real-time.

14. The batting sleeve sensor system of claim 13 wherein said displaying device comprises a monitor attachable to a rigid netting for viewing by said user, said displaying device being impact-resistant.

15. The batting sleeve sensor system of claim 14 wherein said bat is a baseball-bat.

16. The batting sleeve sensor system of claim 14 wherein said bat is a cricket-bat.

17. A batting sleeve sensor system comprising:

a sleeve comprising; a front surface; a back surface; a top side; a bottom side; a right side; a left side; and at least one memory card-receiving pocket;

at least one sensor;

a memory card;

a computer;

a displaying device; and wiring suitable to communicate signals to and from said at least one sensor;

wherein parameters of said sleeve are defined by said front surface; said back surface; said top side; said bottom side; said right side; and said left side;

wherein said at least one memory card-receiving pocket receives said memory card, such that said memory card is secured in place relative to said sleeve;

wherein said at least one memory card-receiving pocket is located on said back surface of said sleeve;

wherein said sleeve is formed of a stretchable nylon, and said sleeve further comprises hook and loop fastener strips;

wherein said sleeve is wrapped around a barrel portion and handle portion of a bat by overlapping said left side over said right side and attaching said hook and loop fastener strips together;

wherein said barrel portion comprises a circumference of which said sleeve surrounds when positioned thereon;

wherein said handle portion comprises a circumference that increases when approaching said barrel portion of which said sleeve surrounds when positioned thereon;

wherein said bat is a baseball-bat;

wherein said sleeve comprises indicia, and said indicia includes a sweet spot target;

wherein said sweet spot target is divided into four quadrants that are able to map hits when impacted by a ball;

wherein said memory card is capable of saving all measured statistics collected during at least one batting session;

wherein said computer is in communication with and able to read said memory card and able to retrieve said measured statistics said mapped hits such that a user is able to make proper adjustments to said user's bat swing and stance;

wherein said displaying device permits said user to observe said measured statistics in real-time;

wherein said displaying device comprises a monitor attachable to a rigid netting for viewing by said user, said displaying device being impact-resistant;

wherein said wiring communicates said signals to and from said at least one sensor allowing said sensor to measure a measurable property in communication with said computer;

wherein said wiring is integral with said sleeve; and wherein said at least one sensor senses and records information relating to said measurable property when said sleeve is positioned on said bat.

18. A kit comprising the batting sleeve sensor system of claim 17 and further including:

software to implement use of said computer; and a set of user instructions and practice techniques.

* * * * *